US010549449B2

(12) United States Patent
Eiswerth

(10) Patent No.: US 10,549,449 B2
(45) Date of Patent: Feb. 4, 2020

(54) TOOL FREE BOLT SYSTEM FOR A SAW BLADE

(71) Applicant: Robert Bosch GmbH, Stuttgart (DE)

(72) Inventor: Patrick Eiswerth, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 211 days.

(21) Appl. No.: 15/037,865

(22) PCT Filed: Nov. 17, 2014

(86) PCT No.: PCT/EP2014/074790
§ 371 (c)(1),
(2) Date: May 19, 2016

(87) PCT Pub. No.: WO2015/075001
PCT Pub. Date: May 28, 2015

(65) Prior Publication Data

US 2016/0288359 A1 Oct. 6, 2016

Related U.S. Application Data

(60) Provisional application No. 61/908,423, filed on Nov. 25, 2013.

(51) Int. Cl.
*B27B 5/32* (2006.01)
*B27B 5/29* (2006.01)
*B27B 5/30* (2006.01)

(52) U.S. Cl.
CPC *B27B 5/32* (2013.01); *B27B 5/29* (2013.01); *B27B 5/30* (2013.01)

(58) Field of Classification Search
CPC ..... B27B 5/32; F16B 43/002; F16B 31/04
See application file for complete search history.

(56) References Cited

U.S. PATENT DOCUMENTS 640,357 A * 1/1900 Baumgarten ..... B60R 11/0241 248/217.4
4,428,120 A * 1/1984 Kobayashi ..... B27B 5/32 30/390

(Continued)

FOREIGN PATENT DOCUMENTS

CH 449931 4/1968
EP 2006058 A1 * 12/2008 ..... B24B 45/006
WO 9500288 A1 1/1995

OTHER PUBLICATIONS

International Search Report corresponding to PCT Application No. PCT/EP2014/074790, dated Jan. 30, 2015 (4 pages).

*Primary Examiner* — Stephen Choi
*Assistant Examiner* — Liang Dong
(74) *Attorney, Agent, or Firm* — Maginot, Moore & Beck LLP

(57) ABSTRACT

A bolt assembly (100) enables a user to change a circular blade (160) on a power tool (200) without the use of tools. The bolt assembly includes a bolt body (110) that has a bolt head (132) and a shank (136) that extends axially from the bolt head. The bolt head has a shoulder and the shank has external threads that mate with a threaded bore (220) of a drive shaft (212) of the power tool. A grip body (130) is formed circumferentially around the bolt head to facilitate rotation of the bolt body by the user's hand. An upper washer (114), a needle roller thrust bearing (116), and a lower washer (118) are positioned on the bolt head and retained with a retaining clip (120). The bolt body is rotated to press the lower washer against a clamping surface of the circular blade. The bolt assembly permits rotation of the lower washer relative to the bolt body without rotating the bold body.

13 Claims, 6 Drawing Sheets

(56) References Cited

U.S. PATENT DOCUMENTS

| | | | | | |
|---|---|---|---|---|---|
| 5,017,068 | A * | 5/1991 | Cooksey | F16B 23/0061 | 411/373 |
| 5,494,368 | A * | 2/1996 | Matthews | B24B 45/006 | 403/259 |
| 5,533,852 | A * | 7/1996 | Matthews | F16B 43/002 | 411/428 |
| 5,810,533 | A * | 9/1998 | Nakamura | B24B 23/02 | 411/408 |
| 5,924,208 | A * | 7/1999 | Saeki | B23D 61/10 | 30/388 |
| 7,963,003 | B1 * | 6/2011 | Keene | F24C 15/086 | 16/441 |

* cited by examiner

TOOL FREE BOLT SYSTEM FOR A SAW BLADE

This application is a 35 U.S.C. § 371 National Stage Application of PCT/EP2014/074790, filed on Nov. 17, 2014, which claims the benefit of priority to U.S. Provisional Application No. 61/908,423, filed on Nov. 25, 2013 and entitled "Tool Free Bolt System for a Saw Blade," the disclosures of which are incorporated herein by reference in their entireties.

FIELD OF THE INVENTION

The disclosure relates generally to a power tool and, more particularly, to a tool free bolt system for securing a circular blade to a power tool.

BACKGROUND

A miter saw generally includes a circular blade having a centrally located hole for mounting the blade to a rotatable shaft. The blade is conventionally mounted to an end of the rotatable shaft in compression between an inner flange and outer flange or washer and held by a conventional arbor bolt threaded into a threaded bore in the shaft.

Circular saw blades must be replaced periodically due to blade wear and to accommodate a variety of different cutting uses. In order to install or remove a blade, a wrench typically must be used to supply sufficient torque to remove the bolt from the shaft. Inconveniences are incurred by the use of a conventional bolt to mount a circular saw blade. For example, the task of obtaining an appropriate wrench can be time consuming, and using the wrench can be cumbersome. Additional inefficiencies can result if the wrench is misplaced between blade changes.

Some existing tool free blade change systems suffer from problems during operation of the saw. A miter saw generates substantial torque when the saw blade rotationally accelerates or decelerates. Such acceleration or deceleration can occur, for example, when the rotating blade first contacts a material to be worked or when the blade first completes a cut and is no longer in contact with the material. In some instances, the saw can generate enough torque to self-tighten the blade change system holding the blade on the saw. It is therefore desirable to provide an improved mechanism for removing and replacing a circular saw blade. Additionally, it is desirable to provide a system that enables a quick and easy removal of the circular saw blade without additional tools.

SUMMARY

A bolt assembly for securing a tool disc to a power tool, in one embodiment, includes a bolt body having a bolt head and a shank extending axially from the bolt head, the bolt head having a bearing surface that faces the shank and the shank having external threads that are matably receivable in a threaded bore of a shaft of the power tool, a grip body extending radially from and circumferentially about the bolt head, the grip body being configured to rotate the bolt body, a lower washer positioned between the bearing surface and the shank, the lower washer being rotatable about the bolt head and having a contact surface configured to be pressed against a clamping surface of the tool disc, and a bearing positioned between the bearing surface and the lower washer, the bearing being configured to allow the lower washer to rotate relative to the bolt body without rotation of the bolt body.

A power tool, in one embodiment, includes a rotatable drive shaft having a threaded bore, a circular blade mounted to the end of the drive shaft, an inner blade washer and an outer blade washer mounted on the drive shaft, the inner blade washer positioned on an inner side of the circular blade and the outer blade washer positioned on an outer side of the circular blade, and a bolt assembly configured to press the outer blade washer against the circular blade and the inner blade washer so as to secure the circular blade to the drive shaft, the bolt assembly including a bolt body having a bolt head and a shank extending axially from the bolt head, the bolt head having a bearing surface and the shank having external threads that are matably receivable in the threaded bore of the drive shaft, a grip body extending radially from and circumferentially about the bolt head, the grip body being configured to rotate the bolt body, a lower washer positioned between the bearing surface and the shank, the lower washer being rotatable about the bolt head and having a contact surface configured to be pressed against the outer blade washer, and a bearing positioned between the bearing surface and the lower washer, the bearing being configured to allow the lower washer to rotate relative to the bolt body without rotation of the bolt body.

DETAILED DESCRIPTION

Figure 1:
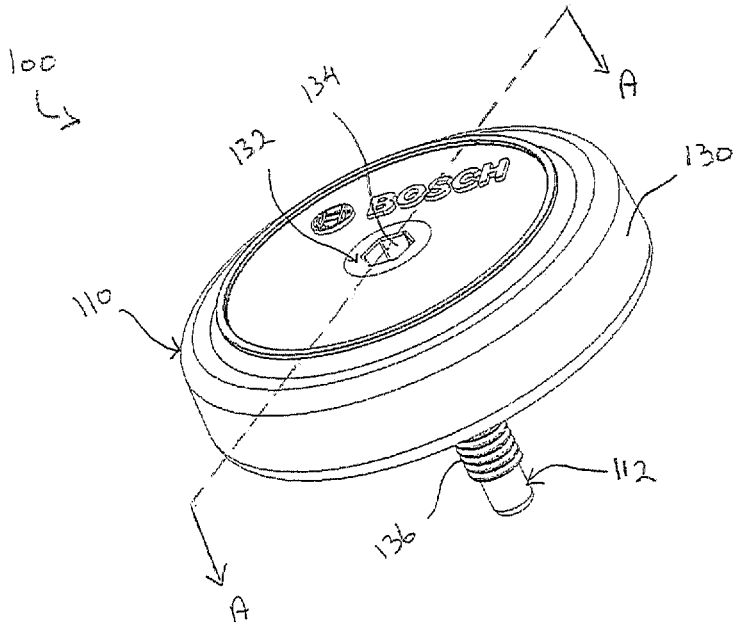
FIG. 1 is a top-perspective view of a tool free bolt system according to the disclosure.
Figure 2:
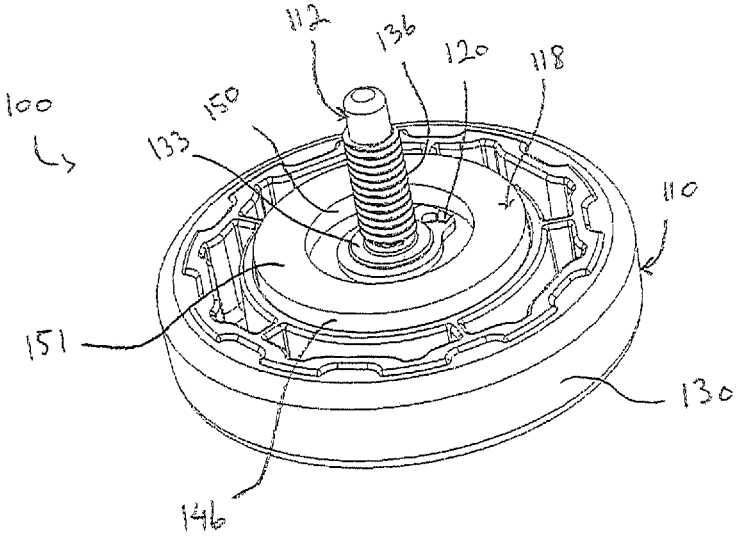
FIG. 2 is a bottom-perspective view of the tool free bolt system of FIG. 1.

For the purpose of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one skilled in the art to which this disclosure pertains.

FIGS. 1-4 depict a tool free bolt system 100 according to the present disclosure. The bolt system 100 includes a main body 110, a bolt 112, an upper washer 114, a thrust bearing 116, a lower washer 118, and a retaining ring 120. With particular reference to the exploded view of FIG. 3 and the section view of FIG. 4, the main body 110 includes an outer surface 122, an inner cavity 124, and an opening 126 extending from the inner cavity 124. The inner cavity 124 is defined inside the main body 110, and includes an annular inner surface 128. The outer surface 122 is arranged around the outside of the main body 110 and is configured to enable a user to manually grip and twist the main body 110.

In the illustrated embodiment, the main body 110 may include a grip portion 130 surrounding a portion of the outer surface 122. The grip portion 130 may be disposed about a periphery of the outer surface 122 along portions the main body 110 that a user would customarily grip in order to rotate the body about a longitudinal axis extending through bolt system 100. In some embodiments, the grip portion 130 is a soft material with high surface friction, such as an elastomeric material, that enables the user to apply sufficient rotational force to the bolt system 100. In other embodiments, the grip portion 130 includes grip features that are adhered onto or formed or cut into the portions of the outer surface 122. The main body 110 and the grip portion 130 are sized and configured to be easily graspable and rotated by a user. In particular, the main body 110 is sized to produce a mechanical advantage to rotate the bolt 112, as described herein.

Figure 4:
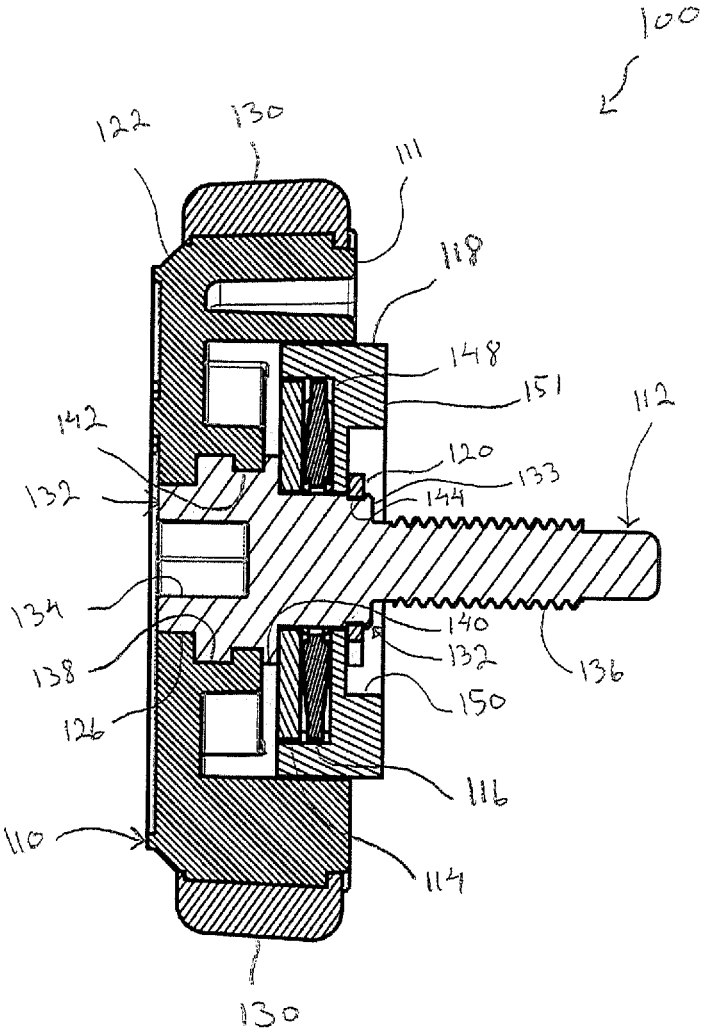
FIG. 4 is a section view of the tool free bolt system of FIG. 1 along a line A-A.

The bolt 112 includes a head 132, which may include an internal hex 134, and a threaded shank 136 extending from the head 132. The head 132 includes an upper shoulder 138, a lower shoulder 140, an upper groove 142 spaced between the upper shoulder 138 and the lower shoulder 140, and a lower groove 144 spaced from the lower shoulder 140, as best seen in FIG. 4. The internal hex 134 is provided in the event the bolt 112 cannot be loosened by hand, in which case the user can loosen the bolt 112 with an appropriate tool or wrench.

The lower groove 144 is configured to accommodate the retaining ring 120 and to hold the retaining ring 120 in a fixed position relative to the bolt 112. The upper washer 114 is configured to contact the lower shoulder 140, while the lower washer 118 is configured to contact the retaining ring 120. The thrust bearing 116 is positioned between the upper and lower washers 114, 118, and each of the upper washer 114, the thrust bearing 116, and the lower washer 118 are retained on the bolt 112 between the lower shoulder 140 and the retaining ring 120. The retaining ring 120 may be in the form of a snap ring used to hold the bolt system 100 together.

Figure 3:
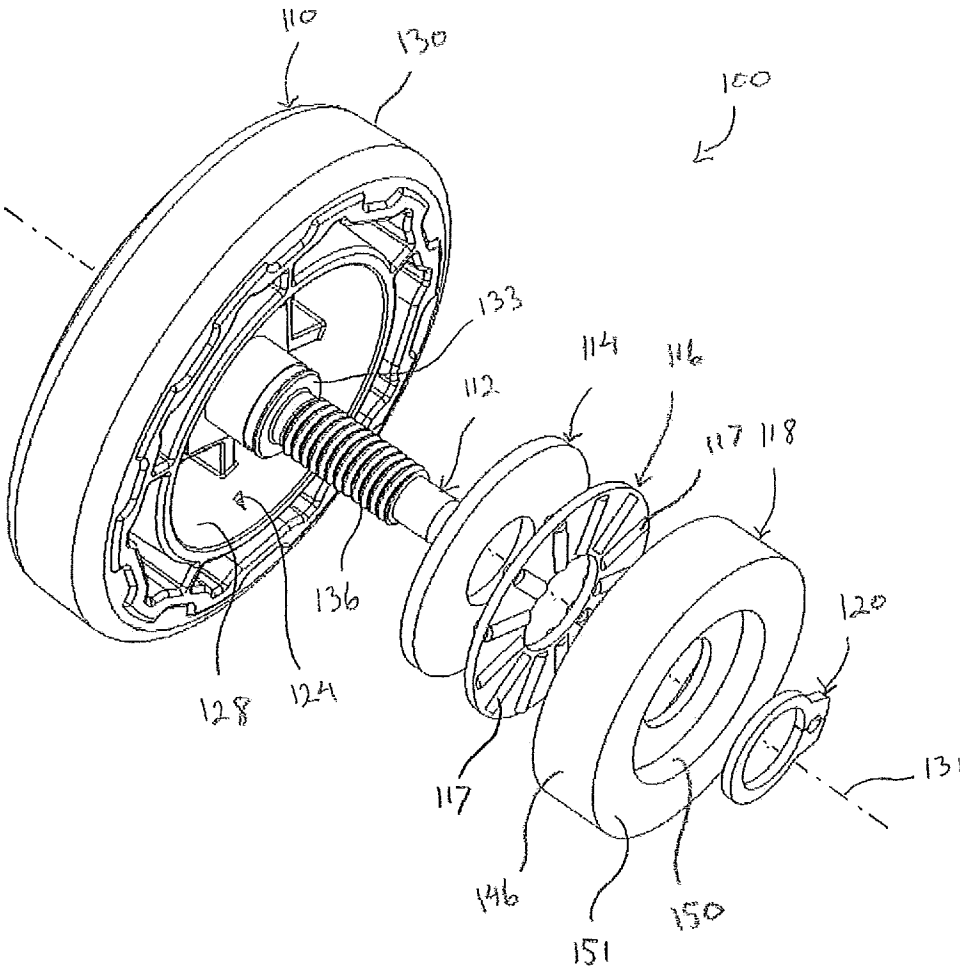
FIG. 3 is an exploded view of the tool free bolt system of FIG. 1.

As best shown in FIGS. 3 and 4, the lower washer 118 includes an annular outer surface 146, an upper recess 148, a lower recess 150, and a contact surface 151. A portion of the lower washer 118 is configured to nest within the inner cavity 124 of the main body 110. The overlapping portions of the annular outer surface 146 of the lower washer 118 and the annular inner surface 128 of the main body 110 are configured to slide freely relative to one another. In the illustrated embodiment, the upper washer 114 and the thrust bearing 116 may be positioned within the upper recess 148 of the lower washer 118. The lower recess 150 is sized so that the lower surface 133 of the head 132 of the bolt 112 is to be flush with or beneath the contact surface 151 of the lower washer 118.

The main body 110 may be configured to be integral with portions of the head 132 of the bolt 112. With particular reference to FIG. 4, and continuing reference to FIGS. 1-3, the main body 110 has an inner web portion and an outer cylindrical portion disposed radially outward from the inner web portion. The outer cylindrical portion defines the inner cavity 124 with the annular inner surface 128. The outer cylindrical portion also defines a lower surface 111 of the main body 110. The inner web portion defines the opening 126 of the main body 110 and surrounds the upper groove 142, the upper shoulder 138, and portions of the head 132 above the upper shoulder 138 to form an interlocking connection between the main body 110 and the bolt 112. In some embodiments, the head 132 may include one or more flat portions positioned about the periphery of the head 132 to enable further interlocking between the main body 110 and the bolt 112. As a result of the integral, interlocking connection, the rotational motion of the main body 110 is transferred to the bolt 112 to enable the main body 110 and bolt 112 to rotate together so as to tighten the bolt 112 and to thereby produce the needed axial force to secure the blade against the inner blade washer 216 (FIGS. 6 and 7).

Figure 5:
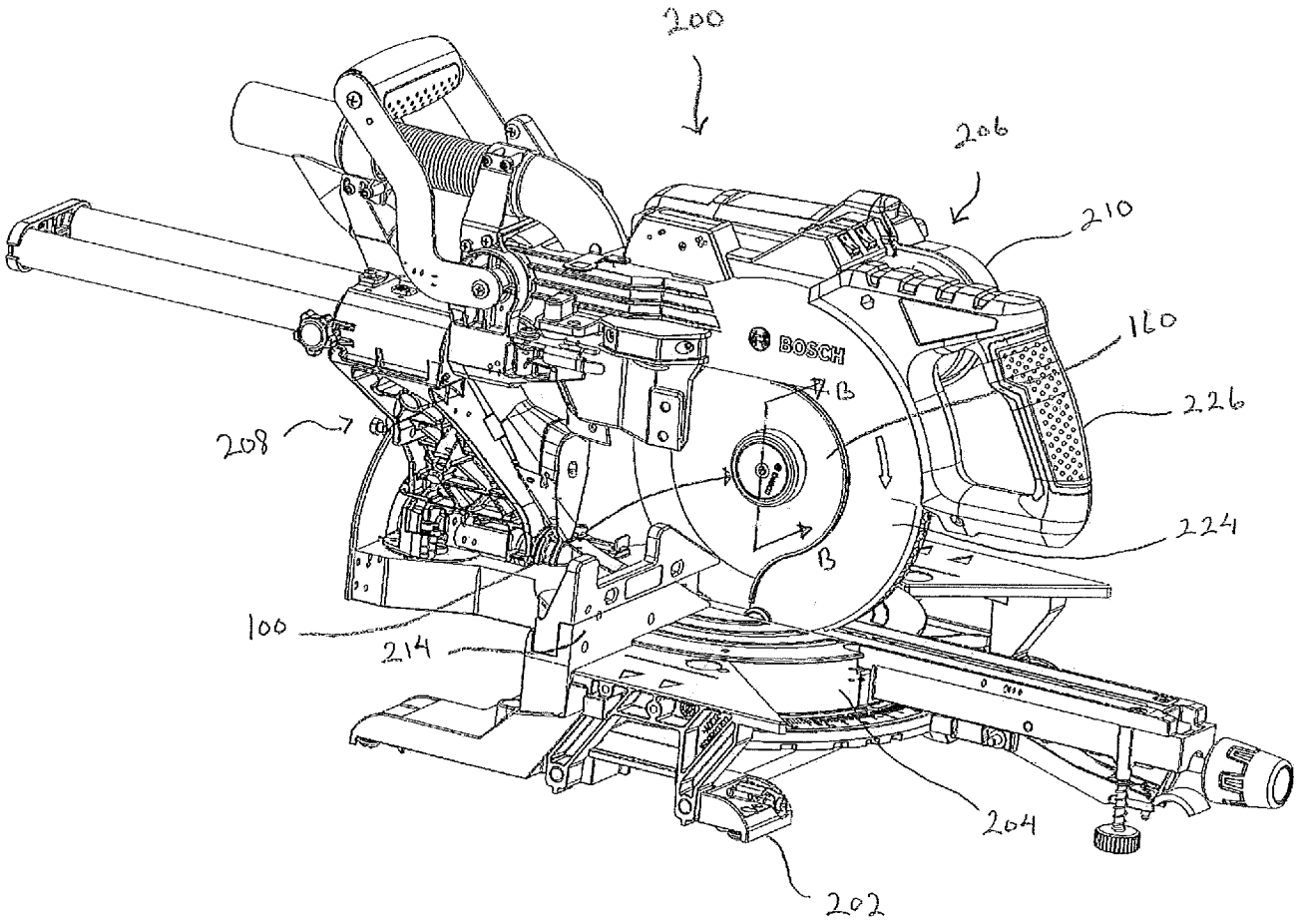
FIG. 5 is a side-perspective view of the tool free bolt system of FIG. 1 securing a circular blade to a miter saw.

FIG. 5 shows the tool free bolt system 100 implemented to secure a circular blade 160 to an exemplary miter saw assembly 200. The miter saw assembly 200 includes a base 202 and a turntable 204 that is rotatable on the base 202. The miter saw assembly 200 further includes a cutting head 206 mounted on a cutting head support assembly 208. The cutting head 206 (which may also be referred to herein as a "cutting assembly") includes a motor 210 that is operable to rotate the circular saw blade 160 via a drive shaft 212 (FIGS. 6 and 7). The cutting head support assembly 208 is attached to the turntable 204 and configured to support the cutting head 206 such that the cutting head 206 may move over the turntable 204 and perform cutting operations on a work piece supported by the turntable 204. A rip fence 214 attached to the base 202 may be used to align a work piece thereon.

The cutting assembly 206 includes a handle 226 to facilitate movement of the cutting assembly 206 in relation to the turntable 204. The handle 226 is designed and dimensioned to be grasped by a human hand when performing a cutting operation. This allows the user to easily pivot the cutting assembly 206. A switch (not shown) may be provided on the handle 226 to allow the user to easily energize and de-energize the electric motor 210 during a cutting operation. A lower blade guard 224 is rotatably mounted to the cutting head assembly 206. The lower blade guard 224 is configured to rotate in a counterclockwise direction with respect to the cutting head assembly 206 when the cutting head assembly 206 is pivoted toward the turntable 204 thereby exposing the circular saw blade 160.

Figure 6:
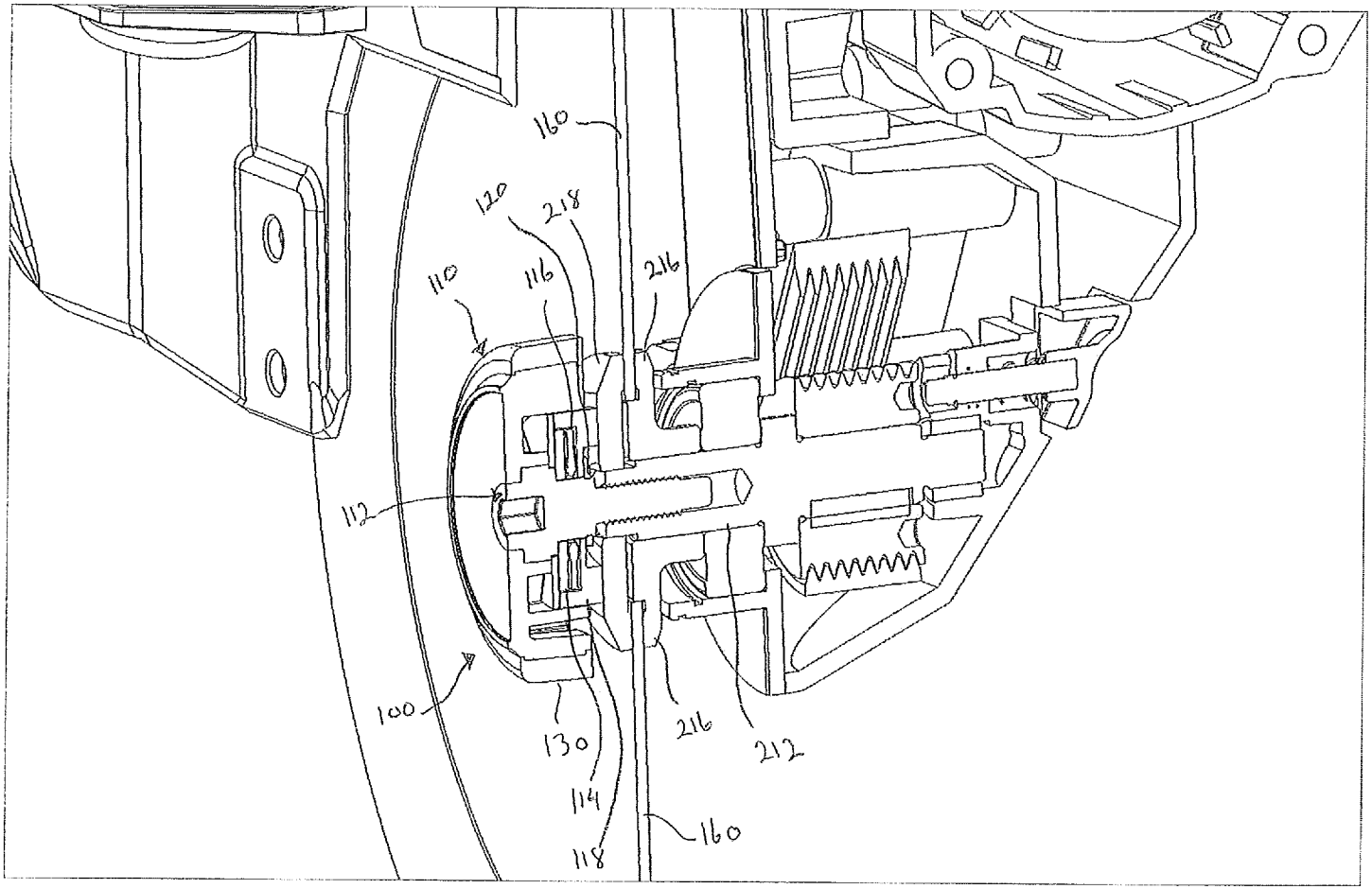
FIG. 6 is a section view of the tool free bolt system and a portion of the miter saw of FIG. 5 along a line B-B shown from a side perspective.
Figure 7:
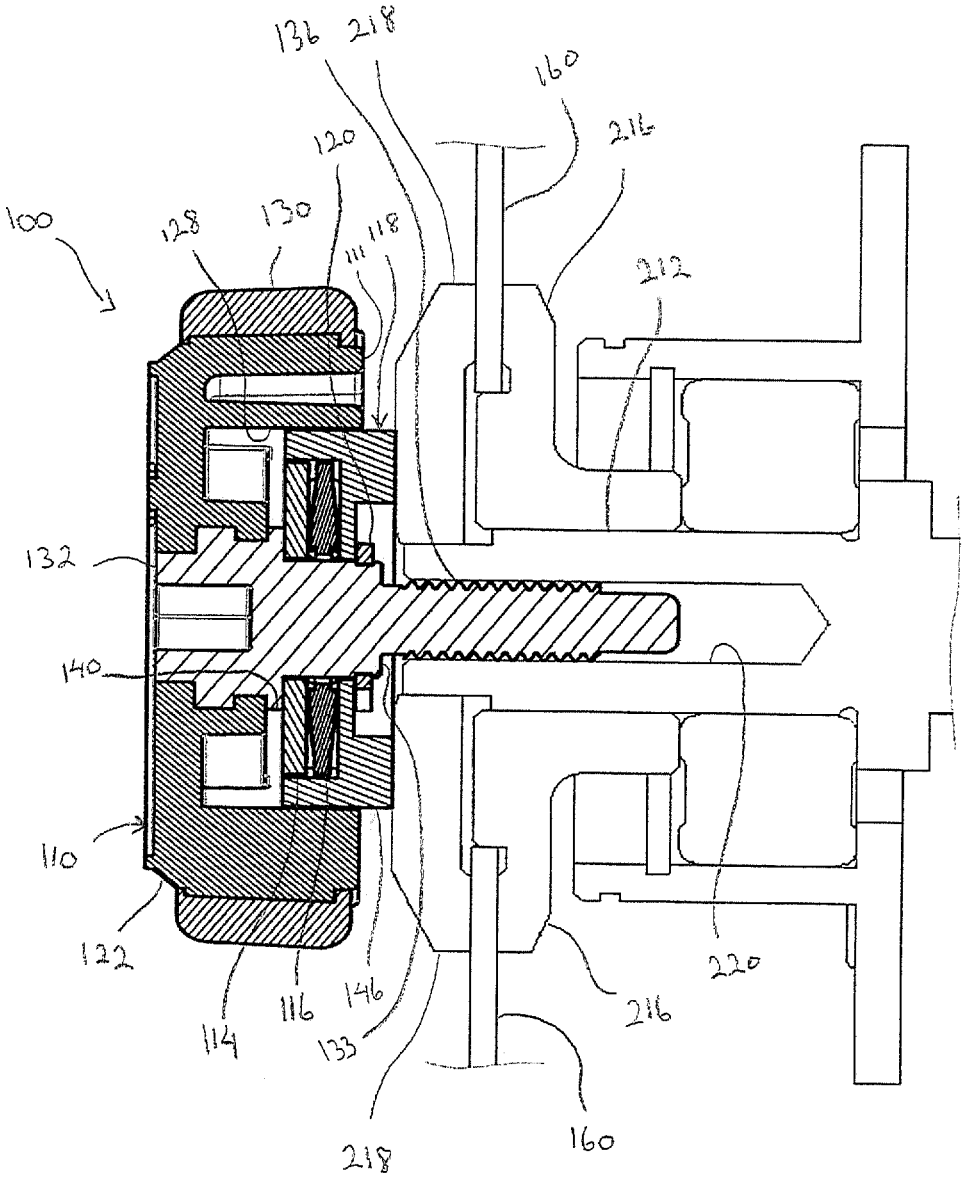
FIG. 7 is a section view of the tool free bolt system and a portion of the miter saw of FIG. 5 along the line B-B.

FIGS. 6 and 7 show section views of the tool free bolt system 100 and the miter saw assembly 200 through the longitudinal axis of the tool free bolt system 100. With particular reference to FIG. 7, the circular blade 160 is mounted to the end of the drive shaft 212 of the miter saw assembly 200 between an inner blade washer 216 and an outer blade washer 218. The threaded shank 136 of the bolt system 100 includes a plurality of threads configured to engage a threaded bore 220 of the drive shaft 212. As explained in more detail below, the rotation of the threaded shank 136 of the bolt system 100 within the threaded bore 220 draws the contact surface 151 of the lower washer into compressive contact with the outer blade washer 218 and fixedly clamps the blade 160 between the inner and outer blade washers 216, 218.

In the illustrated embodiment, the threads of the bolt system 100 and of the bore 220 of the drive shaft 212 are arranged in a left-hand thread, by which is meant the bolt system 100 is tightened by turning the main body 110 counter-clockwise and loosed by turning the main body 110 clockwise. However, it should be appreciated that the system described herein can be applied to a bolt having a right-hand thread as well. It should further be appreciated that in a typical tool, the thread tightening direction of the threads is opposite to the direction of rotation of the drive shaft 212, thereby producing a self-tightening effect.

In operation, a blade 160 to be installed on the miter saw assembly 200 is positioned between the inner and outer blade washers 216, 218 on the drive shaft 212 of the miter saw assembly 200. The tool free bolt system 100 is inserted into the threaded bore 220 of the drive shaft 212. The user grasps the grip portion 130 of the main body 110 to turn the main body 110 in the counter-clockwise direction, or in the case of a left-hand thread, in the clockwise direction.

The rotation of the threaded shank 136 of the bolt 112 within the threaded bore 220 moves the lower shoulder 140 of the bolt 112 in an axial direction towards the drive shaft 212. The movement of the lower shoulder 140 urges the upper washer 114, which in turn urges the thrust bearing 116, which in turn bears against the lower washer 118 in the axial direction towards the drive shaft 212. The continued rotation of the main body 110 of the bolt system 100 moves the contact surface 151 of the lower washer 118 into compressive contact with the outer blade washer 218 to secure the blade 160 in compression between the inner and outer blade washers 216, 218.

The tool free bolt system 100 disclosed herein has the advantage that no friction is generated between the lower surface 111 of the main body 110 and the outer blade washer 218 when the bolt system 100 is threaded into the drive shaft 212 because the main body 110 is offset by the lower washer 118. If normal contact friction was to occur between the main body 110 and the clamping surface, such as in the case of some existing designs, at least some of the torque applied by the user would be offset by this friction. The user in this situation may not be able to generate enough torque to tighten the bolt with the proper pre-load, resulting in blade slippage between the blade washers during cutting. However, since the main body 110 of the bolt system 100 is spaced from the outer blade washer 218, no friction is generated between the main body 110 and the blade washer, even when the lower washer 118 is compressed against the outer blade washer 218. Moreover, the mating surfaces between the lower washer 118 and the main body 110 are configured for generally friction-free sliding, as described previously.

The tool free bolt system 100 has the further advantage that the bolt system 100 is not prone to self-tightening. During cutting operations, the cutting force on the blade is transmitted via friction to the blade washer, which is then transmitted as torque to the bolt securing the blade on the saw. In some existing bolt systems, the torque transmitted to the bolt causes the bolt to self-tighten. When this occurs in a tool-free change system, the bolt can be tightened with significantly more torque than the user applied, making it very difficult or impossible to remove the bolt by hand. The thrust bearing 116 of the tool free bolt system 100 disclosed herein eliminates friction between the upper and lower washers 114, 118 and prevents the torque generated by the cutting load on the blade from being transferred to the bolt. In one embodiment, the thrust bearing 116 may include tapered rollers 117 that contact the upper and lower washers 114, 118. The rollers 117 substantially eliminate any torque transmission between the two washers 114, 118, whether during initial tightening of the bolt 112 or during operation of the saw assembly.

In an alternative embodiment of the tool free bolt system, a low friction material may be used between the upper and lower washers 114, 118 in place of the thrust bearing 116. The low friction material can include plastics such as Acetal (POM), Nylon (PA), or other polymers. The low friction material can also include metals such as brass or other oil impregnated sintered metals. In yet another embodiment of the tool free bolt system, a low friction coating, such as nickel or Teflon, is applied to the upper and lower washers 114, 118 to reduce the frictional contact therebetween and to substantially reduce or eliminate torque transmission between the washers 114, 118.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A bolt assembly for securing a tool disc to a power tool, comprising:

a bolt body having a bolt head and a shank extending axially from the bolt head, the bolt head defining a first planar bearing surface that faces the shank and the shank having external threads that are matably receivable in a threaded bore of a shaft of the power tool;

a grip body extending radially from and circumferentially about the bolt head, the grip body interlocked with the bolt body so as to rotationally secure the grip body to the bolt body;

a lower washer positioned axially between the first planar bearing surface and the shank and being rotatable about the bolt head, the first planar bearing surface configured to press a contact surface of the lower washer against a clamping surface of the tool disc in response to a rotation of the grip body; and a bearing positioned between the bearing surface and the lower washer, the bearing being configured to allow the lower washer to rotate relative to the bolt body without rotation of the bolt body, wherein:

the bolt head has a first shoulder protruding radially from the bolt head, the first shoulder defining the first planar bearing surface, the bolt head has a second shoulder protruding radially from the bolt head and spaced from the first shoulder in a direction axially away from the shank, and the grip body is configured to fill the space between the first shoulder and the second shoulder so as to further interlock the grip body and the bolt body and axially secure the grip body to the bolt body.

2. The bolt assembly of claim 1, further comprising an upper washer positioned between the first planar bearing surface and the bearing, the upper washer defining a second planar bearing surface that faces the shank, the first and second planar bearing surfaces configured to press the contact surface of the lower washer against the clamping surface of the tool in response to the rotation of the grip body.

3. The bolt assembly of claim 1, wherein the bearing is configured as a needle roller thrust bearing having a plurality of radially extending rollers.

4. The bolt assembly of claim 1, wherein the grip body has an inner web portion attached to the bolt head and an outer cylindrical portion disposed radially outward from the inner web portion, the outer cylindrical portion having a lower surface that is set back from the contact surface of the lower washer.

5. The bolt assembly of claim 4, wherein the outer cylindrical portion of the grip body defines a grip cavity opening towards the shank, the lower washer being at least partially slidably nested within the grip cavity.

6. The bolt assembly of claim 4, wherein the inner web portion of the grip body is configured to fill the space between the first shoulder and the second shoulder so as to further interlock the grip body and the bolt body and axially secure the grip body to the bolt body.

7. The bolt assembly of claim 6, wherein the bolt head has at least one flat surface extending parallel to shank, the inner web portion of the grip body being configured to surround the flat surface so as to further interlock the grip body and the bolt body and rotationally secure the grip body to the bolt body.

8. The bolt assembly of claim 1, wherein the lower washer defines an upper cavity opening towards the bearing surface and a lower cavity opening towards the shank, the bearing being at least partially slidably nested within the upper cavity of the lower washer.

9. The bolt assembly of claim 8, wherein the bolt head defines an annular groove positioned proximate to the shank, the bolt assembly further comprising a retaining clip inserted into the annular groove and configured to retain the bearing and the lower washer on the bolt head.

10. The bolt assembly of claim 9, wherein the bolt head has a lower surface facing the shank, and wherein the retaining clip and the lower surface are nested within the lower cavity of the lower washer.

11. The bolt assembly of claim 1, wherein the bolt head defines an internal cavity opening away from the shank, the internal cavity having a circumferential profile corresponding to a tool configured to rotate the bolt body.

12. The bolt assembly of claim 1, wherein the bearing is formed from one or more of a low friction plastic, a low friction metal, or an oil impregnated sintered metal.

13. The bolt assembly of claim 1, wherein the grip body includes a grip surface disposed about a circumferential periphery of the grip body and configured to facilitate rotation of the grip body by a hand of a user, the grip surface including one or more of an elastomeric material having high surface friction, a plurality of grip features adhered to the grip body, and a plurality of undulations formed or cut into the grip body.

* * * * *